US010017982B2

(12) United States Patent
Abolhoda

(10) Patent No.: US 10,017,982 B2
(45) Date of Patent: Jul. 10, 2018

(54) EARTHQUAKE RESISTING DOOR

(71) Applicant: Massoud Abolhoda, Santa Barbara, CA (US)

(72) Inventor: Massoud Abolhoda, Santa Barbara, CA (US)

( * ) Notice: Subject to any disclaimer, the term of this patent is extended or adjusted under 35 U.S.C. 154(b) by 0 days.

(21) Appl. No.: 15/235,105

(22) Filed: Aug. 12, 2016

(65) Prior Publication Data

US 2018/0044975 A1 Feb. 15, 2018

(51) Int. Cl.

| | |
|---|---|
| ***E06B 5/10*** | (2006.01) |
| ***E05D 15/38*** | (2006.01) |
| ***E05D 15/26*** | (2006.01) |
| ***E06B 3/48*** | (2006.01) |
| ***E05B 65/00*** | (2006.01) |
| ***E05C 9/08*** | (2006.01) |

(52) U.S. Cl.

CPC ..... *E06B 5/10* (2013.01); *E05B 65/0021* (2013.01); *E05C 9/08* (2013.01); *E05D 15/262* (2013.01); *E05D 15/38* (2013.01); *E06B 3/483* (2013.01); *E05Y 2900/106* (2013.01)

(58) Field of Classification Search

CPC . E06B 3/485; E06B 3/486; E06B 9/15; E06B 1/522; E06B 1/6084; E06B 1/045; E06B 2003/7044; E06B 5/10; E05D 15/24; E05D 15/38; E05F 7/005; E05Y 2900/106; E05C 9/08

See application file for complete search history.

(56) References Cited

U.S. PATENT DOCUMENTS 5,048,243 A * 9/1991 Ward ..... E04B 1/98 52/167.4
5,331,786 A * 7/1994 Lippert ..... E04C 3/38 403/205
5,445,206 A * 8/1995 Shepard ..... E05D 15/242 160/201
5,584,332 A * 12/1996 Miller ..... E05D 15/24 160/201
5,718,276 A * 2/1998 Rekret ..... E05D 15/242 160/201
5,911,660 A * 6/1999 Watson ..... E06B 9/02 49/464
5,927,019 A * 7/1999 Ichida ..... E04H 9/02 49/501
6,041,846 A * 3/2000 Langlois ..... B60J 5/14 16/267
6,041,847 A * 3/2000 Lai ..... E06B 3/485 160/235
6,112,799 A * 9/2000 Mullet ..... E05B 65/0021 160/201

(Continued)

*Primary Examiner* — Justin B Rephann
(74) *Attorney, Agent, or Firm* — Intellectual Property Venture Group; Raymond E. Roberts

(57) ABSTRACT

An earthquake resisting door has locking mechanisms between the door panel top, sides, and the bottom foundation. Included are self-contained limited uplift resisting end posts, one or more door panels made of wood, steel, or other suitable material that can act as a shear wall or brace frame, and segmented door panels that can be designed for roll-up or folding. The segments interlock to create one solid wall or arrangement of segments that creates brace frame action. An inter-locking mechanism engages adjacent door leaves in a casement arrangement and creates one panel.

16 Claims, 20 Drawing Sheets

(56) References Cited

U.S. PATENT DOCUMENTS

| | | | | |
|---|---|---|---|---|
| 6,192,637 | B1 * | 2/2001 | Boilen | B60J 5/12 160/133 |
| 6,374,551 | B1 * | 4/2002 | Boilen | B60J 5/12 160/133 |
| 7,905,056 | B2 * | 3/2011 | Kornfield | E05D 15/24 16/DIG. 1 |
| 2002/0108325 | A1 * | 8/2002 | Hulls | B60J 5/12 52/204.1 |
| 2003/0051827 | A1 * | 3/2003 | Snyder | E06B 3/485 160/201 |
| 2003/0205340 | A1 * | 11/2003 | Nadar | E06B 3/485 160/236 |
| 2004/0079494 | A1 * | 4/2004 | Snyder | E06B 3/485 160/201 |
| 2004/0144503 | A1 * | 7/2004 | Metz | E05D 13/145 160/199 |
| 2005/0194106 | A1 * | 9/2005 | Scales | E05D 15/24 160/201 |
| 2006/0032157 | A1 * | 2/2006 | Baryla | E04B 2/7457 52/167.1 |
| 2007/0261314 | A1 * | 11/2007 | Kornfield | E05D 15/24 49/504 |
| 2011/0011025 | A1 * | 1/2011 | Dorsy | E04C 2/08 52/588.1 |
| 2012/0216967 | A1 * | 8/2012 | Johnson | E04H 6/42 160/340 |

* cited by examiner

Section A-A

EARTHQUAKE RESISTING DOOR

CROSS-REFERENCE TO RELATED APPLICATIONS

This application claims the benefit of U.S. Provisional Application No. 62/138,147, filed Mar. 25, 2015, and is a continuation-in-part of U.S. application Ser. No. 15/081,835, filed Mar. 25, 2016, hereby incorporated by reference in their entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

Lateral load resisting shear walls and frames have been used since beginning of the last century to resist those components of force induced in a building by an earthquake, winds, and similar loads. All current system used in resisting these lateral loads are physically fixed in place and therefore cannot be used in the front of a door, garage, or other opening at the exterior or within a building as they will obstruct access or flow into and out of the building by people, vehicles, or other equipment; will not allow for the passage of air, water, or other elements, or will obstruct sound and visibility.

In particular, natural events causing a lateral load on the building, such as earthquake, are transient in nature. That is, they occur rarely and randomly and for a short period time over the life of the building. Additionally, opening at the exterior of a building, such as garage doors, are typically in a closed position most of the time.

Systems used to resist lateral loads (loads parallel to ground, 90 degrees from gravity) such as seismic forces, wind, tornados, and others are usually resisted by walls, space frames, and braced frames. However, a lot of the time a floor plan does not allow for installation of a wall or braced frame because of the obstruction that these will cause in an opening such as a garage opening, store front, open floor areas, etc.

Accordingly, what is needed are improved systems to allow doors, screens, and panels be installed that will provide lateral resistance.

BRIEF SUMMARY OF THE INVENTION

Accordingly, it is an object of the present invention to provide an earthquake resisting door.

Briefly, one preferred embodiment of the present invention is an earthquake resisting door having an open position and a closed position. The door includes one or more door panels, and end posts located at the left and right sides of the door panels. The door also includes side locking mechanisms having male and female parts. The side locking mechanisms are located between each end post and adjacent door panels, such that the male and female parts inter-lock when the door is in the closed position. The door also includes a top locking mechanism, also having male and female parts. The top locking mechanism is located above the top most door panel, such that the male and female parts inter-lock when the door is in the closed position. And the door includes a bottom locking mechanism. The bottom locking mechanism is located below the bottom most door panel, such that the male and female parts inter-lock when the door is in the closed position.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE SEVERAL VIEWS OF THE DRAWING(S)

The purposes and advantages of the present invention will be apparent from the following detailed description in conjunction with the appended figures of drawings in which.

Figure 9A:
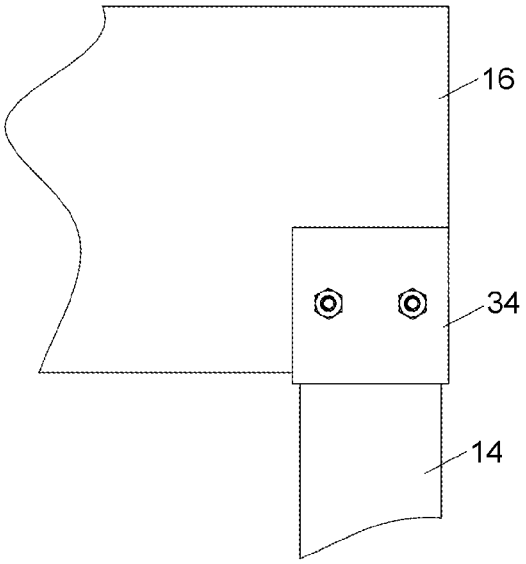
Figure 9B:
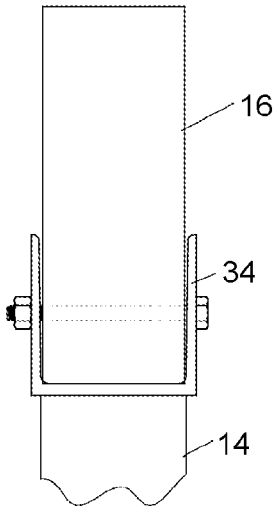
Figure 10:
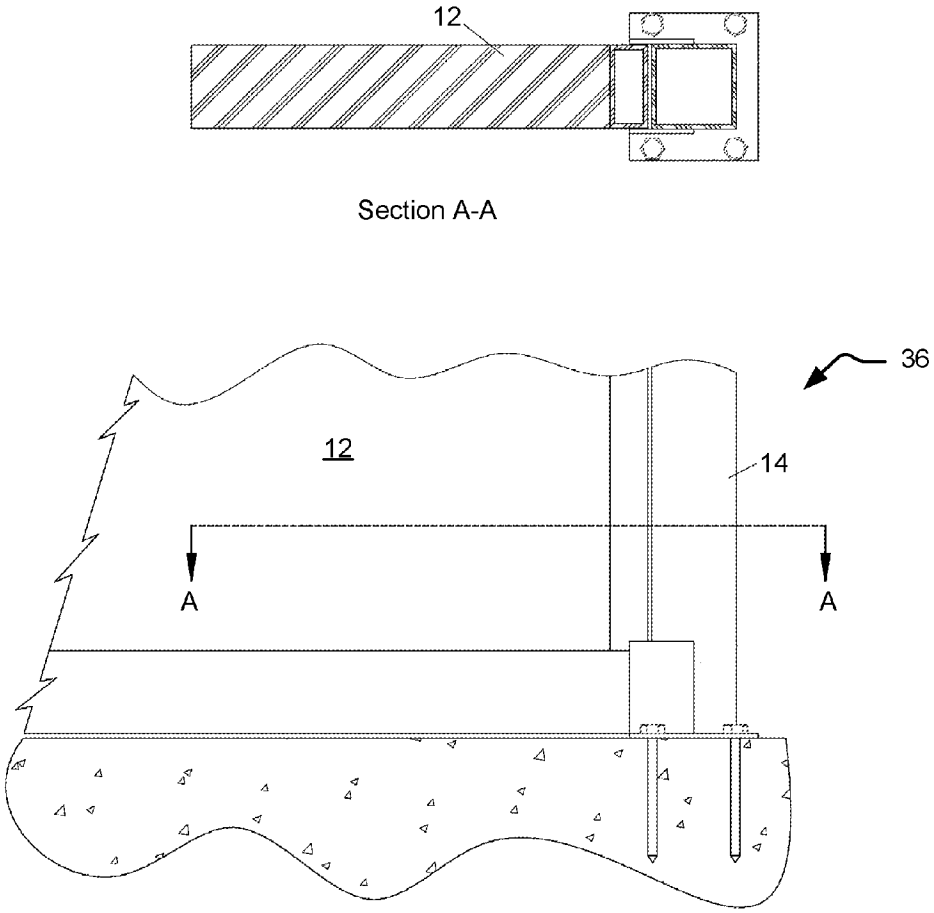
Figure 11:
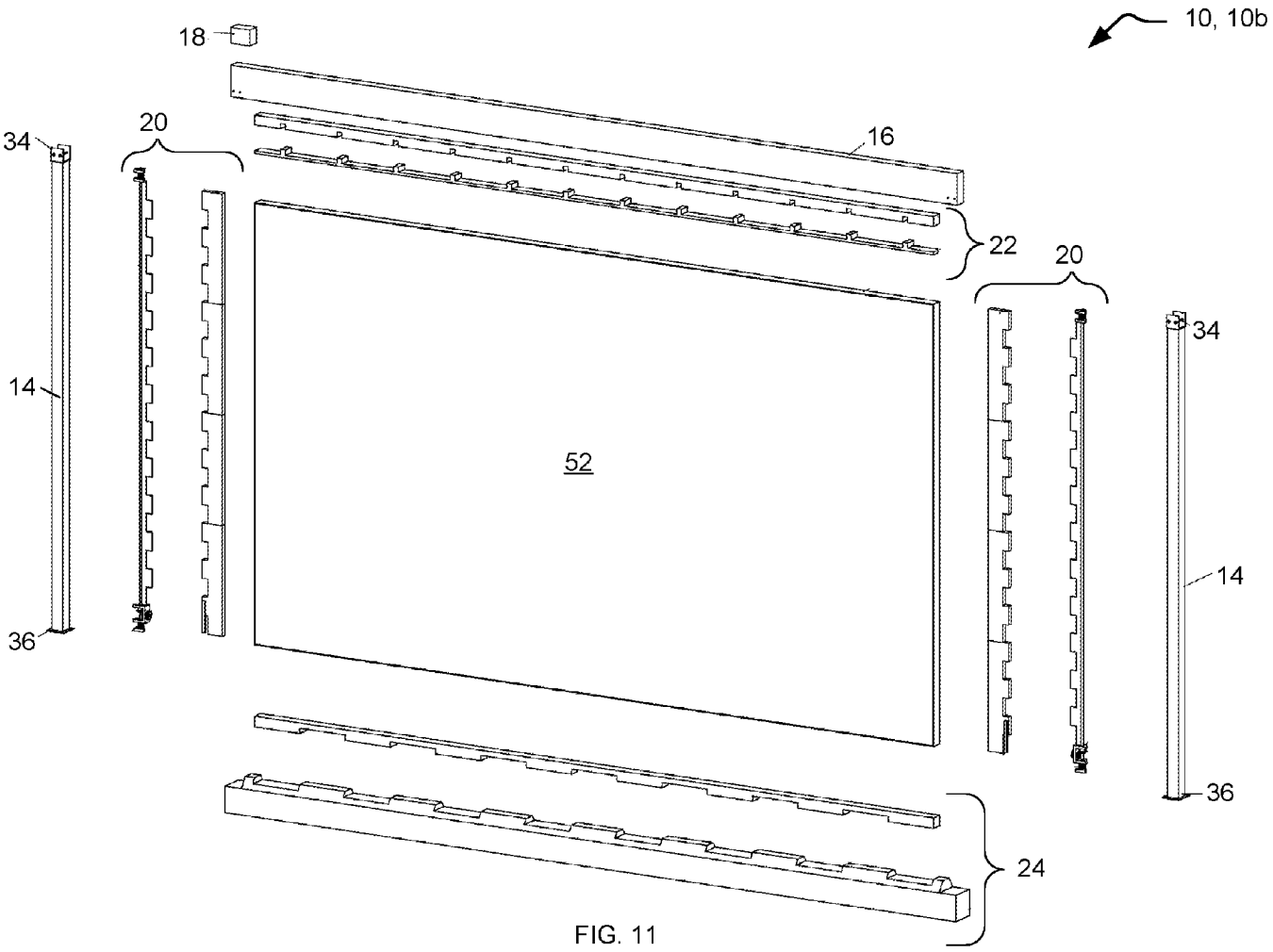
Figure 12:
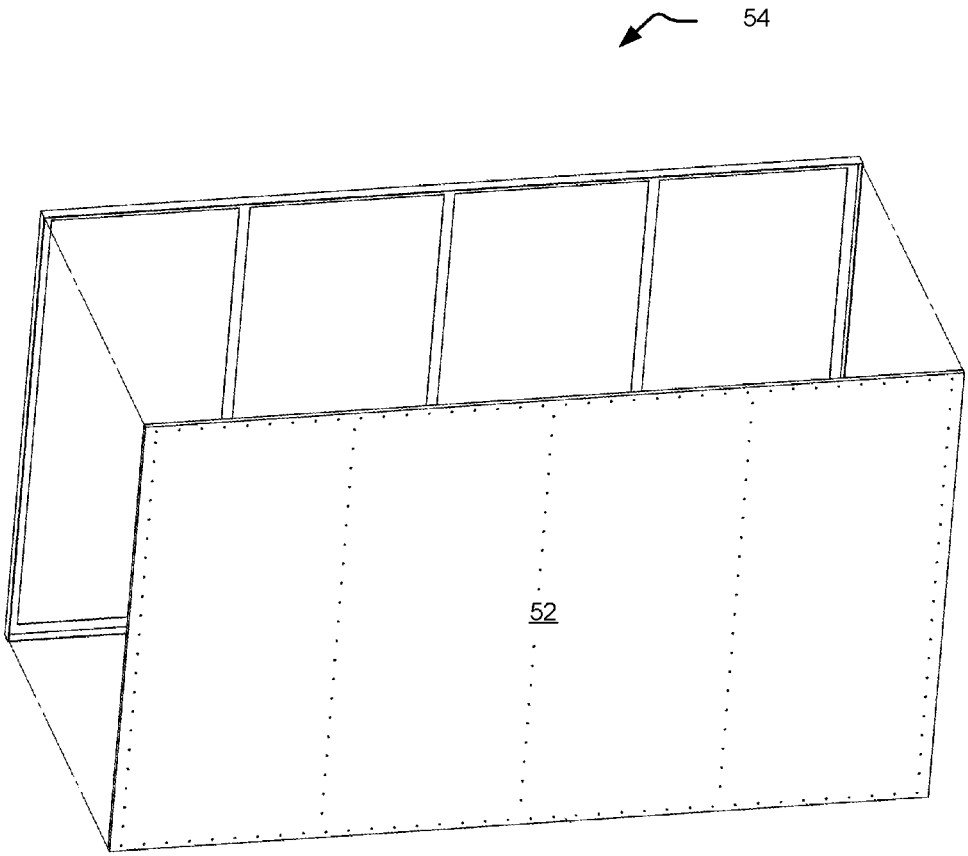
Figure 13A:
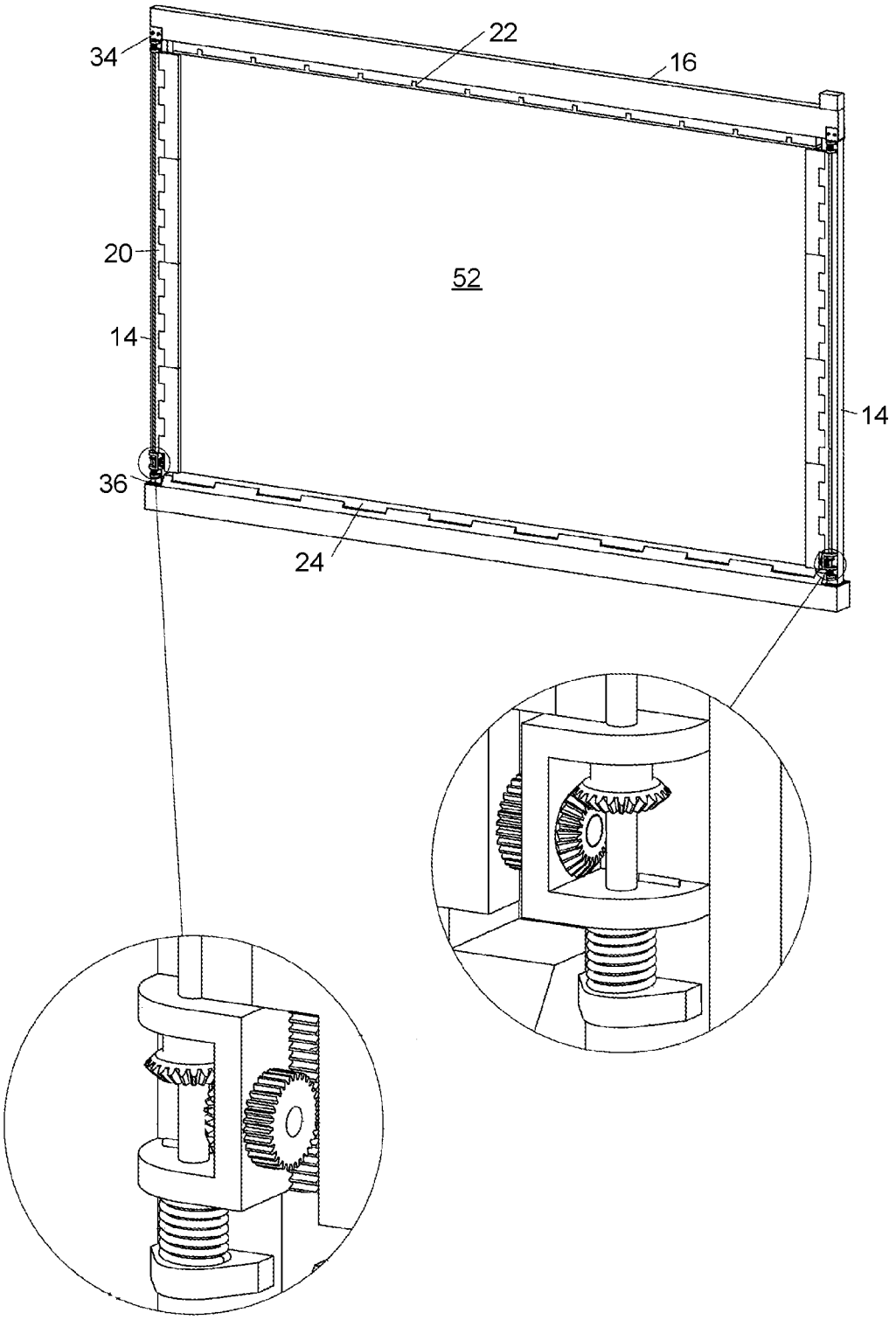
Figure 13B:
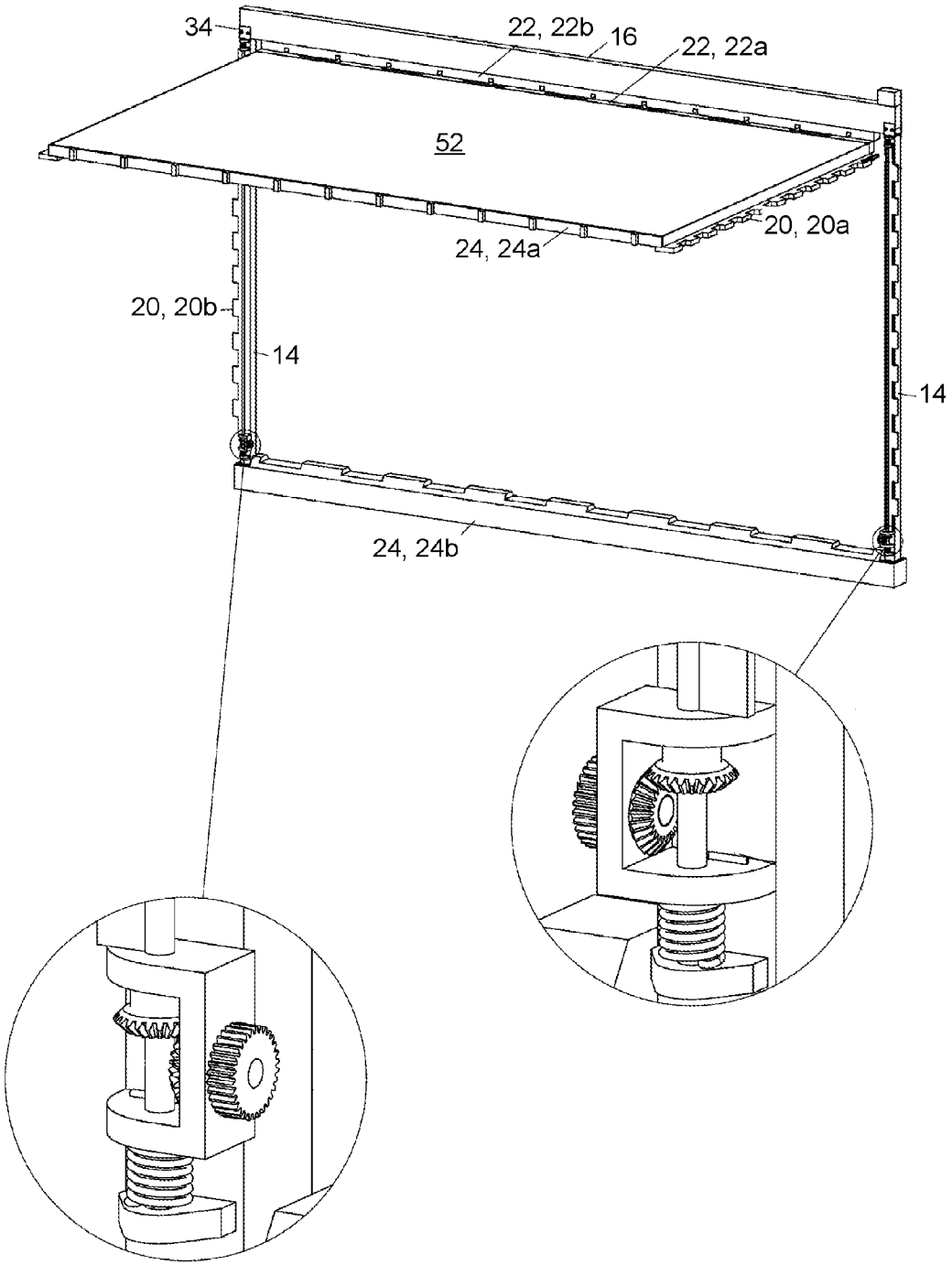
Figure 14:
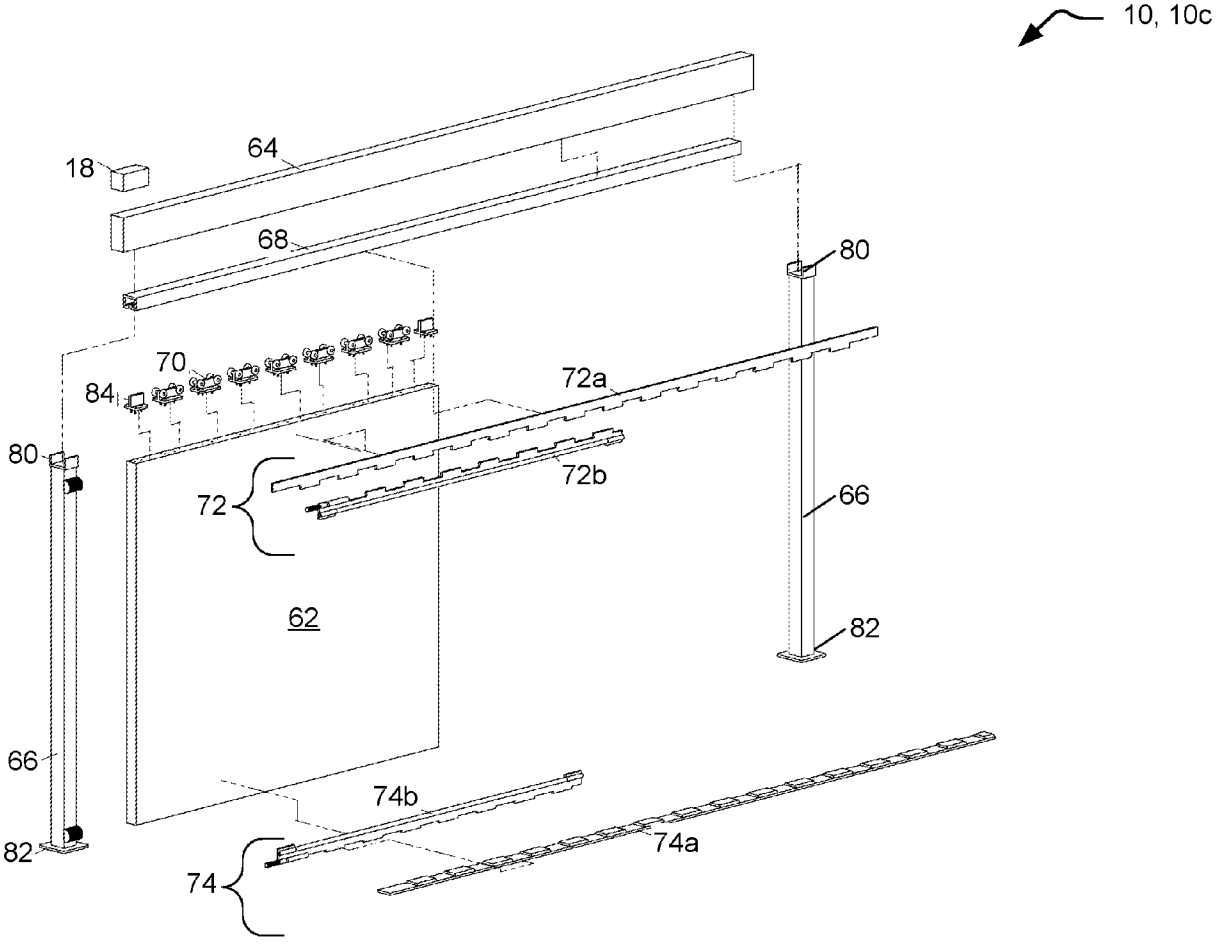
Figure 15:
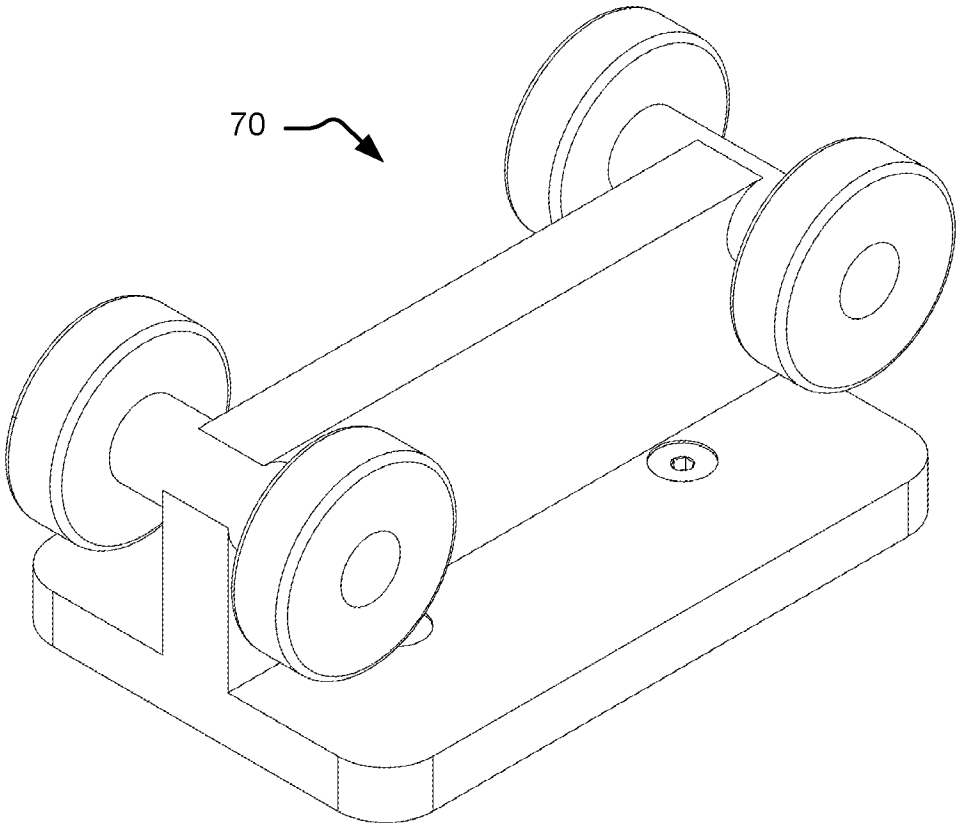
Figure 16:
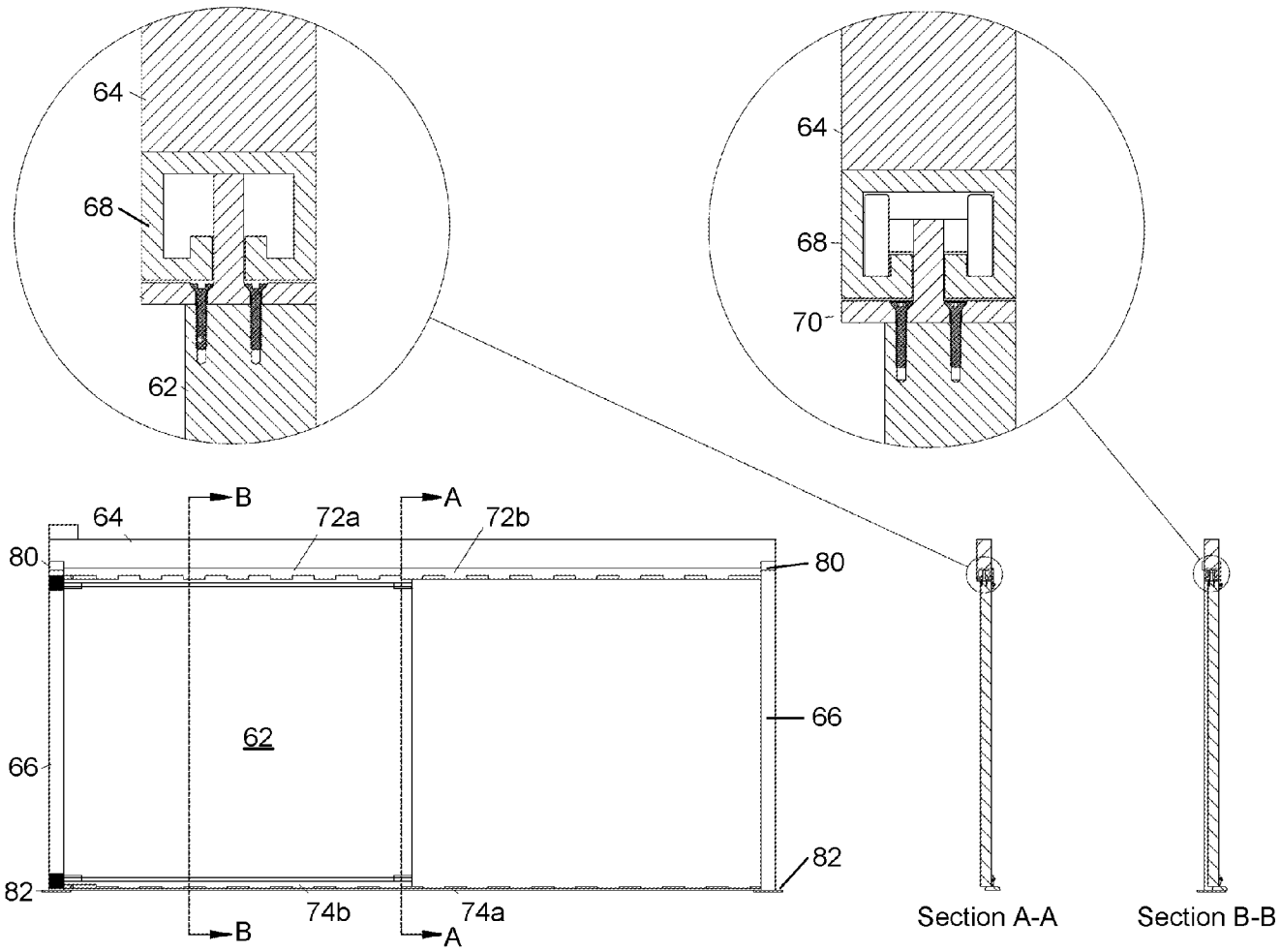
Figure 17:
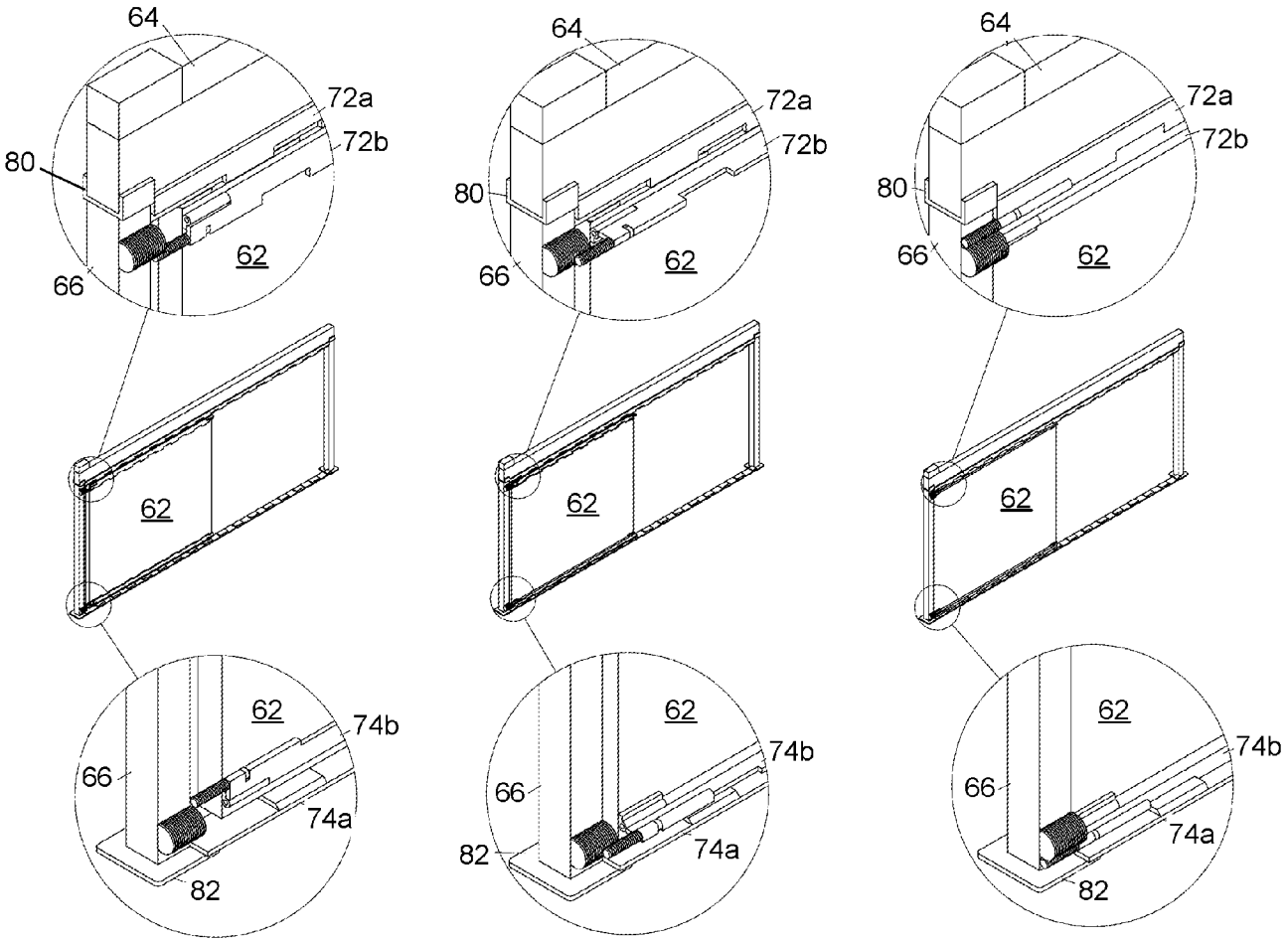
Figure 18:
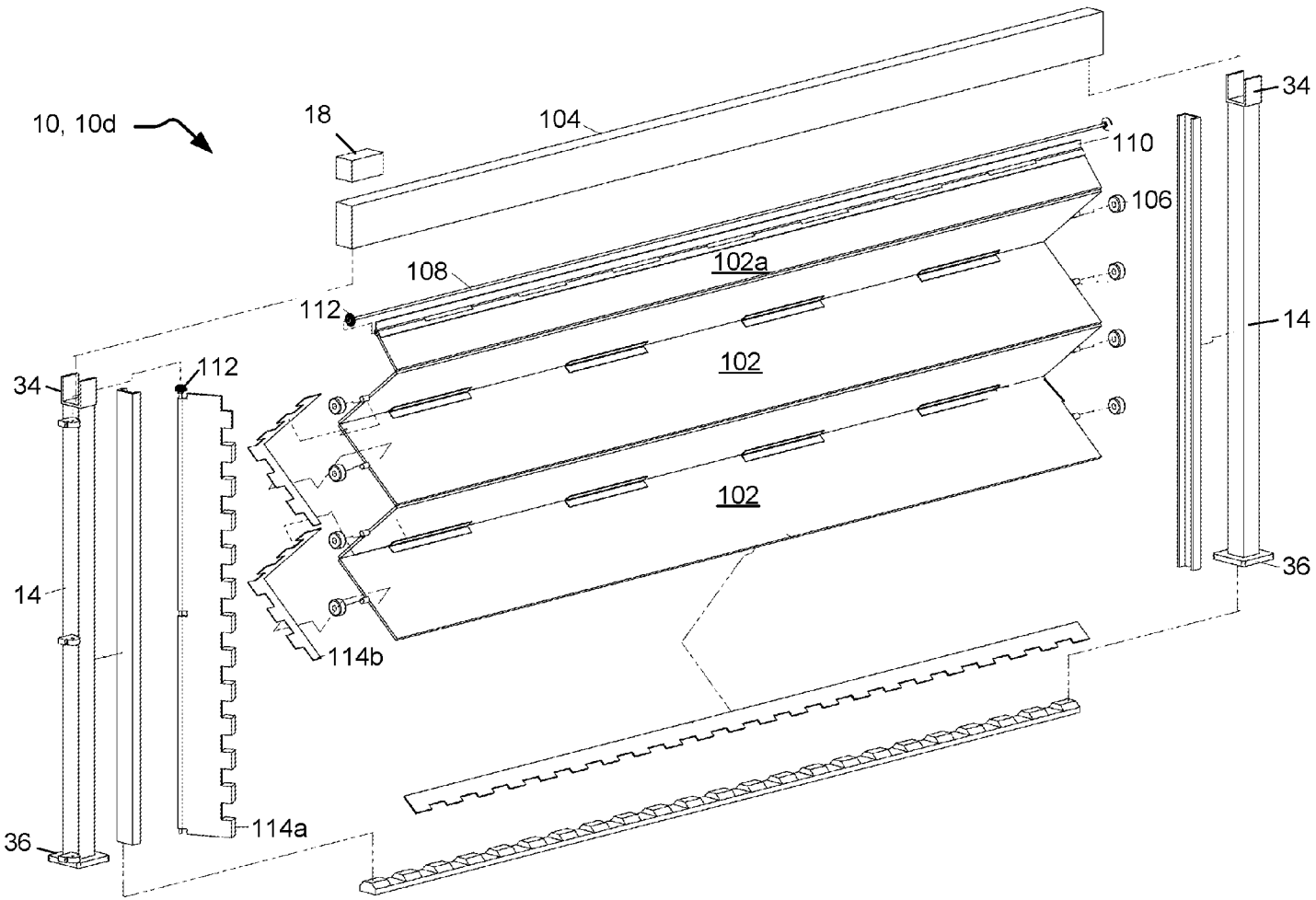
Figure 19:
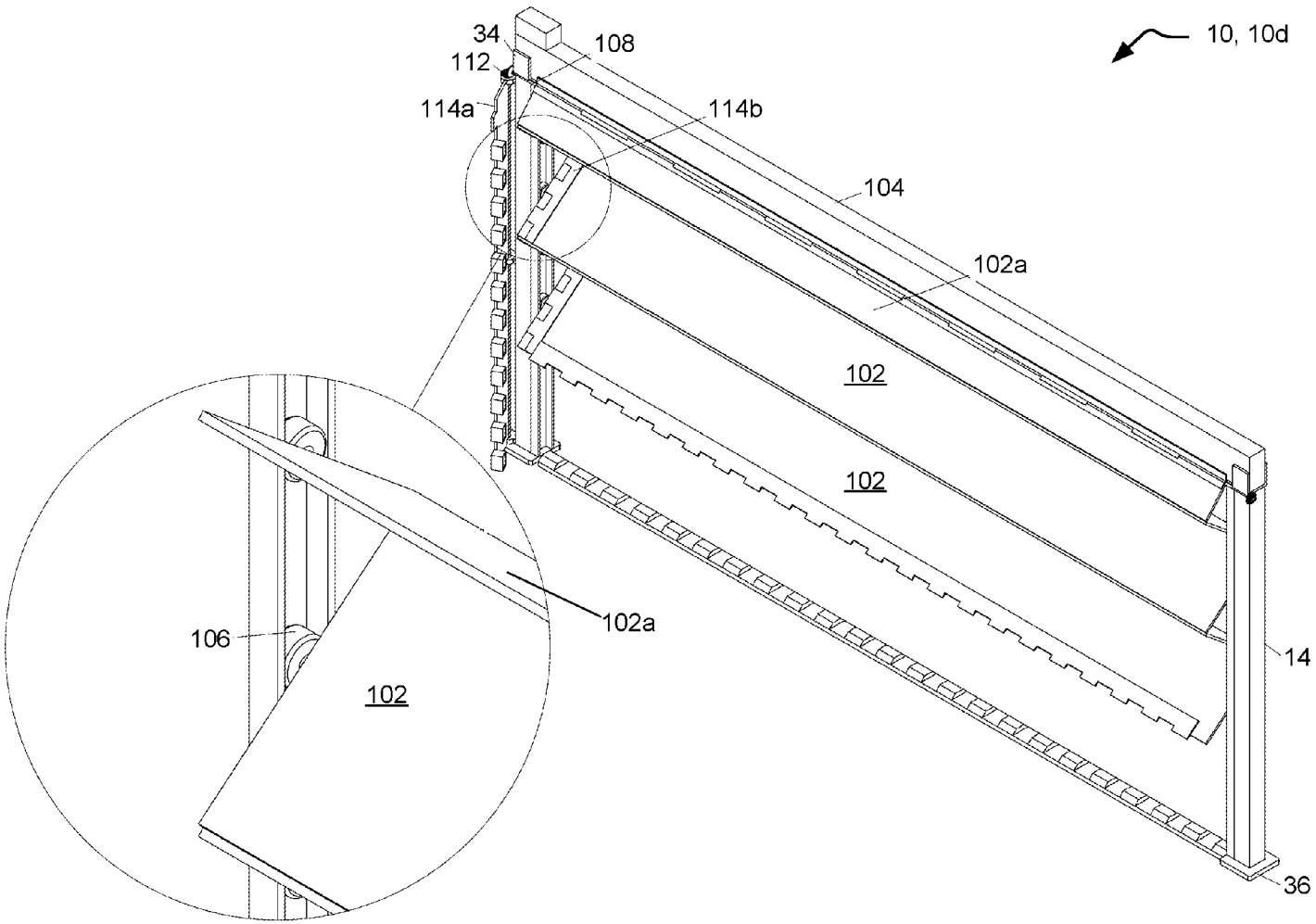

FIGS. 9*a-b* show views of a post top connector;

FIG. 10 shows a post bottom connector;

FIG. 11 is a blown up schematic depiction of a tilt up door in accord with the present invention;

FIG. 12 shows how the door panel of FIG. 11 has a backing grid;

FIGS. 13*a-b* show additional detail of the tilt up door of FIG. 11, in open and closed positions;

FIG. 14 is a blown up schematic depiction of a sliding door in accord with the present invention;

FIG. 15 shows a door roller and hanging mechanism, which hangs from the top track and connects to the top of the door panel;

FIG. 16 shows details, in two positions, of the top connection of the sliding door;

FIG. 17 shows details of the bottom connection, in three positions, of the sliding door;

FIG. 18 is a blown up schematic depiction of a vertical folding door in accord with the present invention;

FIG. 19 shows details of a side locking mechanism; and

Figure 20A:
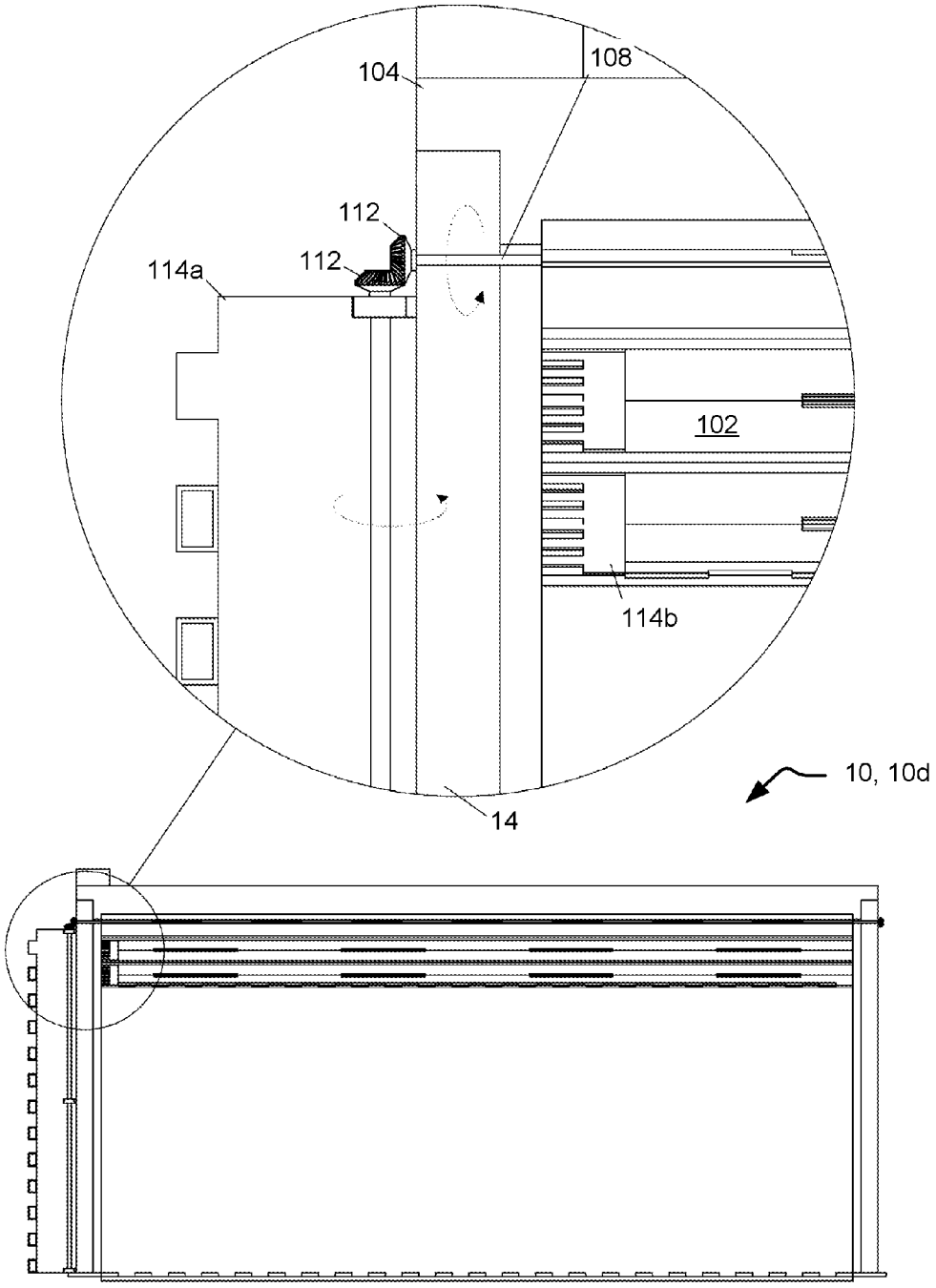
Figure 20B:
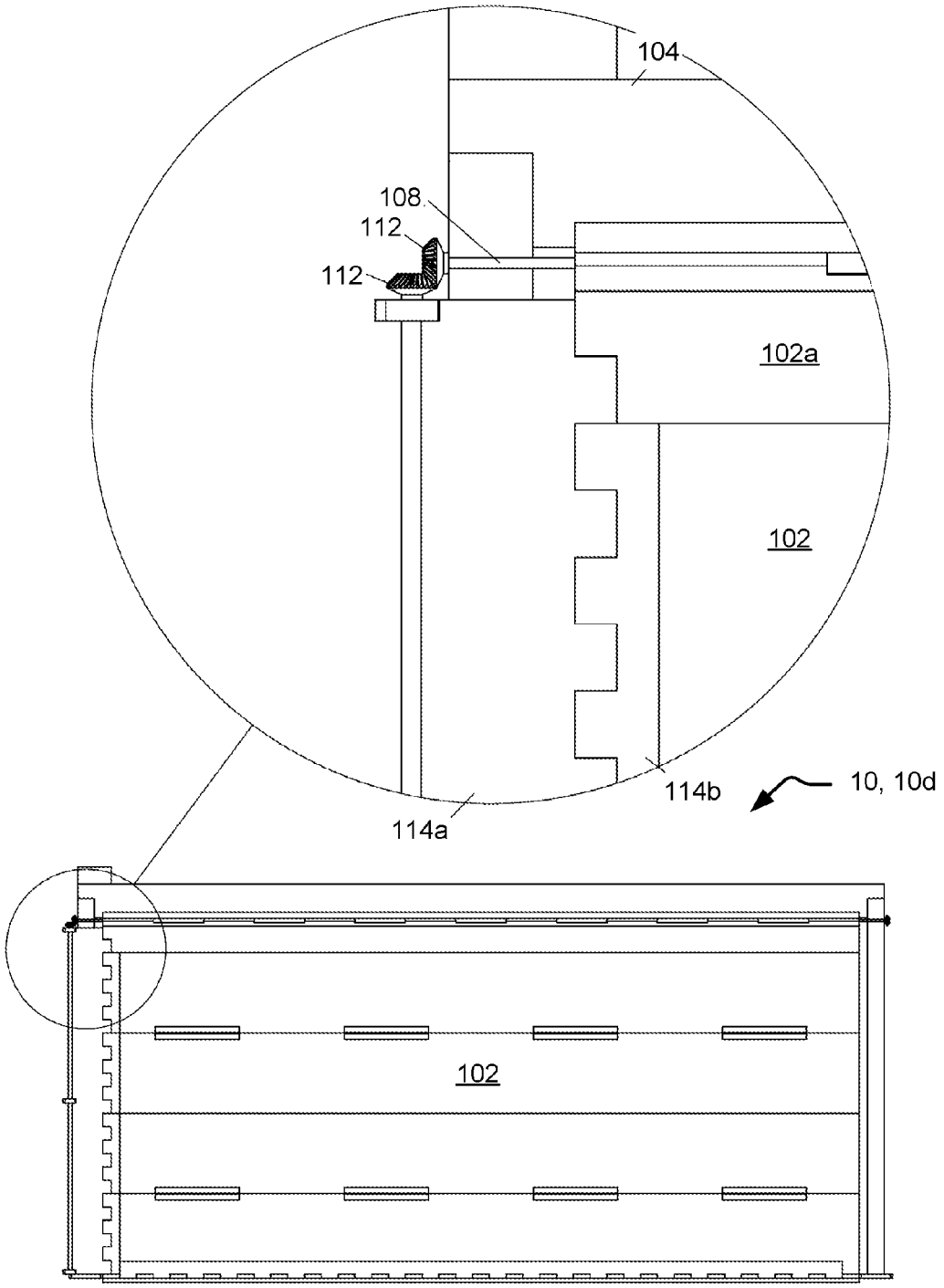

FIGS. 20*a-b* show additional details of a side locking mechanism, in door open and door closed positions;

In the various figures of the drawings, like references are used to denote like or similar elements or steps.

DETAILED DESCRIPTION OF THE INVENTION

A preferred embodiment of the present invention is an earthquake resisting door. As illustrated in the various drawings herein, and particularly in the views of FIGS. 1, 11, 14, and 18 preferred embodiments of the invention are depicted by the general reference character 10.

The Earthquake Resisting Door is an earthquake resisting system that can help to resist earthquake loads when it is locked in place. The door can be of any type, roll up, roll down, sliding, lift/flip, split, folding, etc.

Background

The present system is used to resist lateral loads (loads parallel to the ground, i.e., 90 degrees from gravity) such as seismic, wind, tornado and others that are usually resisted by wall, space frames, and braced frames. A lot of the time floor plans do not allow installation of walls and braced frames where needed because of the obstruction that these cause in the openings, such as garage openings, store fronts, and open floor areas. The purpose of this invention is to allow doors, screens, and panels be installed and to provided lateral resistance in the way now described.

Concept

The locking systems, described below, are suitable for use with doors involving three separate concepts.

1) Single Panel (e.g., Tilt Up) and Multi-Panel (e.g., Roll Up and Fold Up) Earthquake Type Doors In most single garage houses, the doors are closed more than 99 percent of the time. These garage doors are designed to be engaged with the frames on the top and the two sides as well as the foundation and slab below, to provide lateral support. The possibility of the door not being in the closed position at the time of an earthquake is small.

2) Fast Acting Motion Actuated Type Doors

These doors are design to be closed quickly as soon as a certain level of motion is detected. These doors can be used in open front stores or when another method is not considered desirable.

3) Sliding Type Doors

A sliding door works in cases when multiple bays of openings are available in parallel, such as in front of a multi-parking apartment structure. In the open position the door slides over, behind or in front of, an adjacent bay that is in the closed position. This is called a temporary position. When one of the doors are open (in a temporary position) the other doors are kept in the close position and provide lateral resistance. Also, if necessary, sliding doors can be designed to provide lateral resistance in a temporary position by having the door engaged with the structure at the top and the foundation at the bottom.

Components of the Doors

1. A locking mechanism between the various door parts and the side tracks and the foundation or slab.
2. Self-contained limited uplift resisting end posts.
3. A fast acting door that shoots into place in less than 2 seconds in an earthquake.
4. Door panels made of wood or steel, or any other material that can act as a shear wall and/or brace frame.
5. Segmented panels that can be designed into a roll-up or folding panel. The segments interlock to create one solid wall or arrangement of segments that create brace frame action.
6. An inter-locking mechanism that engages adjacent leaves of a door in a casement arrangement and creates one panel.

Locking System

The locking system can consist of any of these:

A) A series of prods, anchors, shear keys, or gears that, in the closed position, either automatically fall into matching slot or holes in the end post, the top tracks, or the bottom tracks, e.g., for top and bottom connection of the roll up type door.

B) A series rotating metal bars (tracks) with prods or shear keys connected to gears. The gears are design to translate opening and closing movement of the door to rotating of metal bars (tracks) and its longitudinal axis. In closed position the prods or shear keys fall and intrude to matching slot or holes in the door panel and interlock to transfer the loads (for the roll up, tillup, and fold up type doors). A similar mechanism, but with a cylindrical gear, is used to rotate top and bottom metal bars into matching slots or holes in the top track and bottom track.

C) A locking system can also be actuated through a magnetic system or be actuated with an electrical signal, releasing the door interlocking system in the open door position but which is fail-safe in the closed door position.

The main concept of the invention is a shear or brace panel that opens in a different manner to provide access, but in final closed position or resting position works as an integrated shear wall or braced panel to transfer any shear load and associated overturning moments from the floor above to the floor below.

1) Interlocks with the headers or floor above to collect lateral loads.

2) Transfers the shear load within the body or panel to the floor below.

3) The panel can be of one single panel, such as a tilt-up model, or a multiple segmented panel.

4) In a segmented panel the shear is transferred from one panel to the next by connectors that allow for spatial movement of the panels yet interconnects them to transfer the shear as well as upward and downward loads caused by overturning.

5) The panel is connected to the floor below with an interlocking system that can be a shear key, magnetic, interlocking rod, or bearing or bottom chord connected to the end post or bearing pedestal.

6) In addition to, or in combination with interlocking system, the shear from the bottom of the lowest panel can be transferred to an end an post in a load bearing manner.

7) The upward or downward load of the panel or segmented panel can be achieved with the interlocking system.

8) In-addition to the interlocking system, the uplift transfer can be achieved by load bearing on the end of a top panel on a header. Then the header transfers that load to an end post and the end post transfers the load to the floor below.

Roll Up Door

Figure 1:
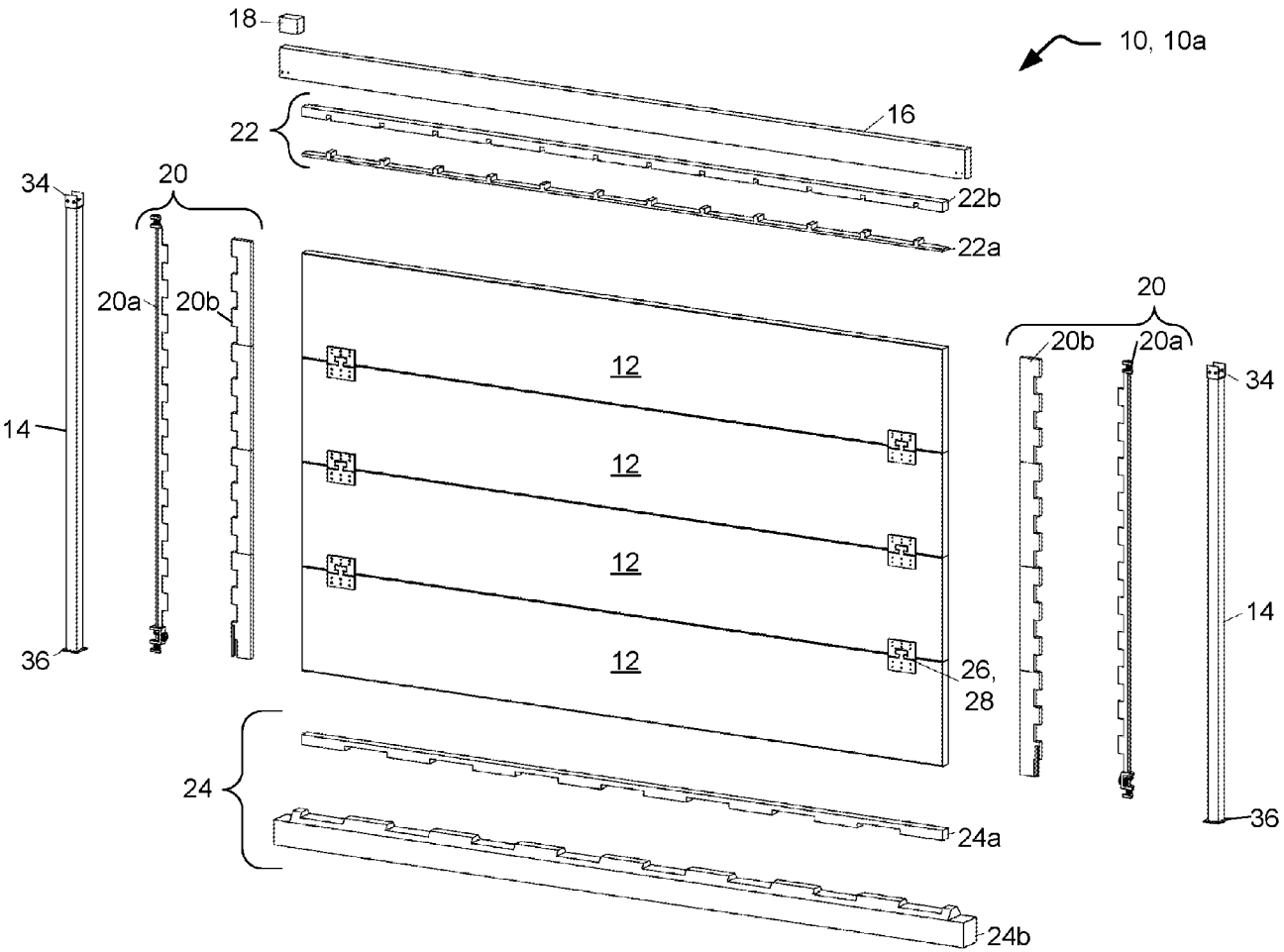
FIG. 1 is a blown up schematic depiction of a roll up door in accord with the present invention.
Figure 2:
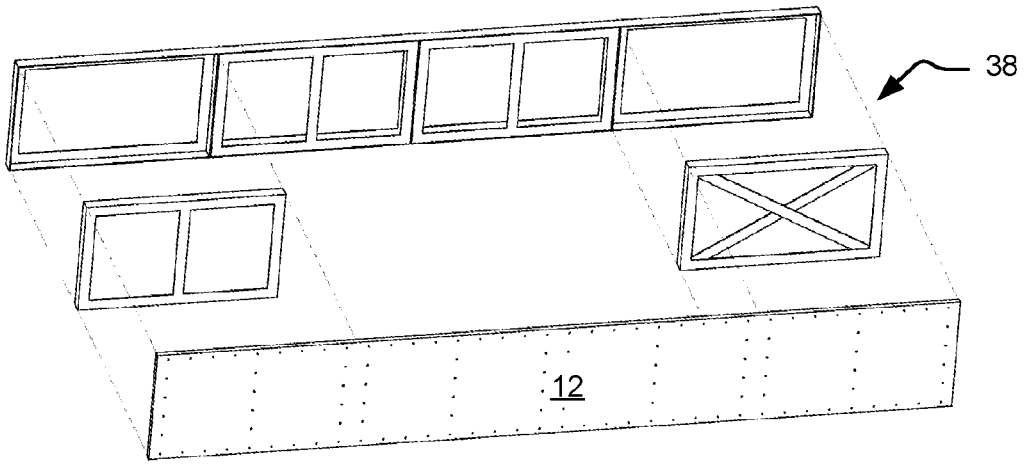
FIG. 2 shows how the door panel of FIG. 1 has a backing grid.
Figure 4:
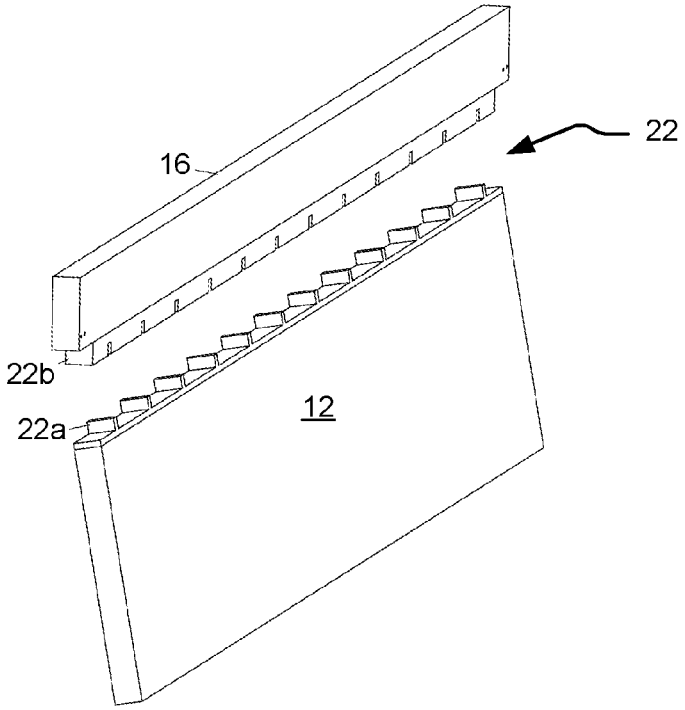
FIG. 4 shows details of a top locking mechanism.
Figure 3:
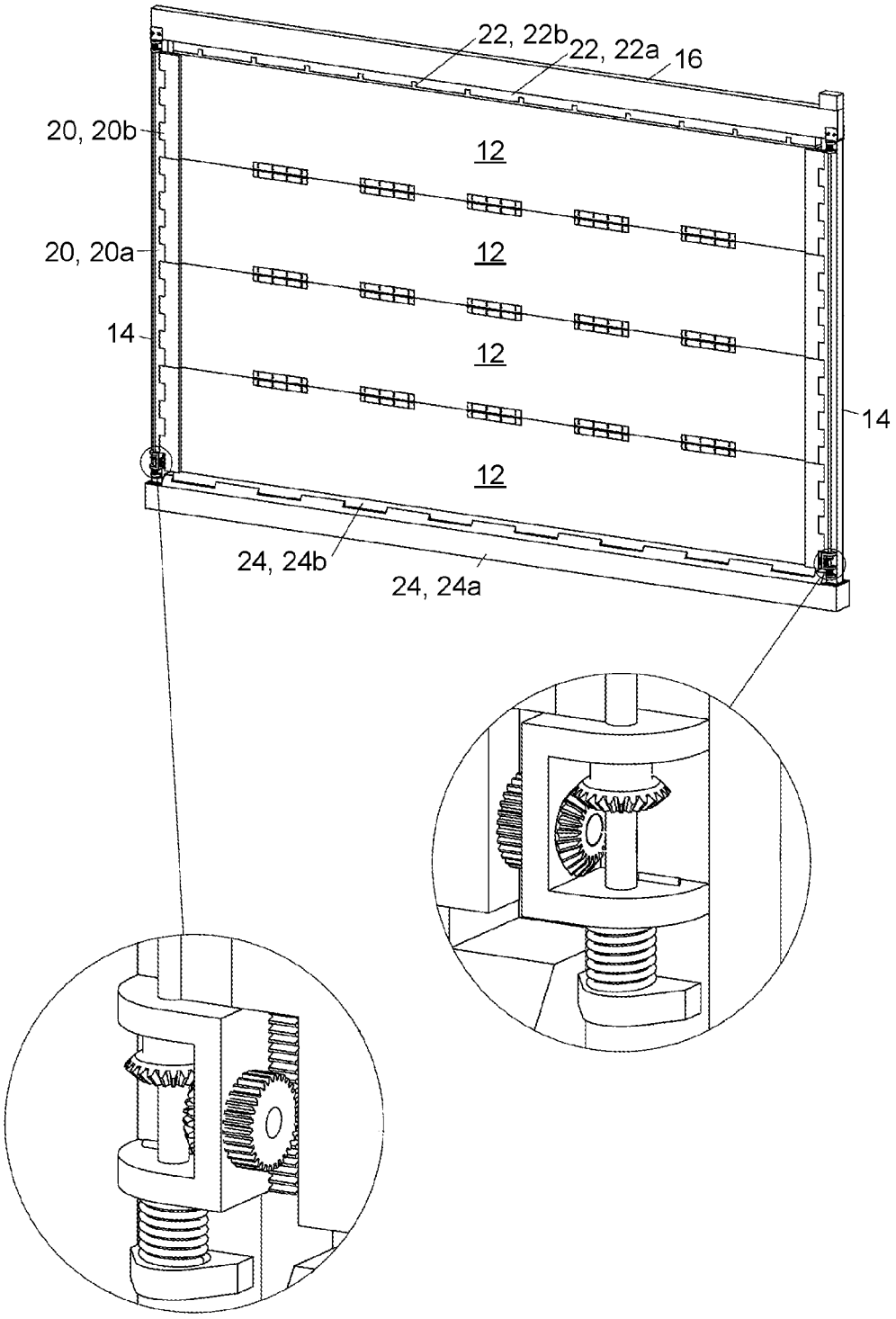
FIG. 3 shows details of a side locking mechanism.
Figure 5:
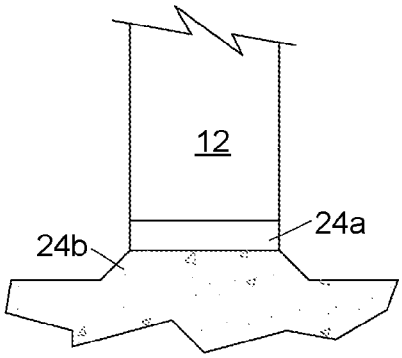
FIG. 5 shows details of a bottom locking mechanism (two types)
Figure 5:
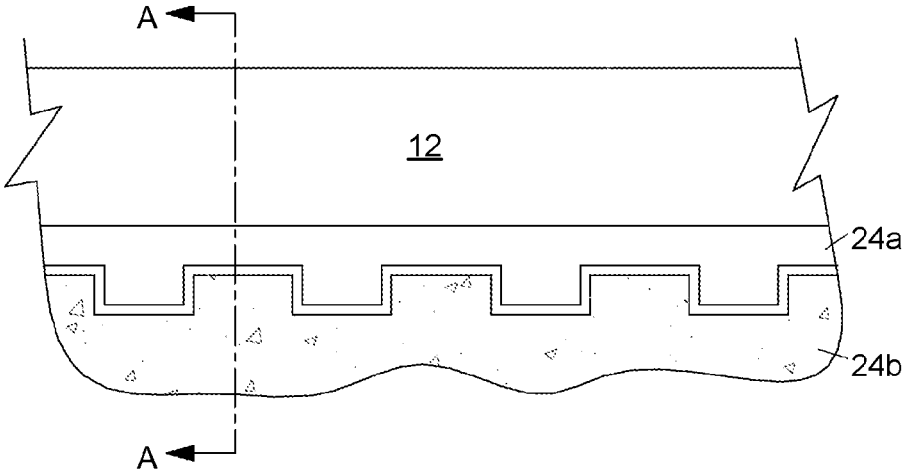
Figure 5:
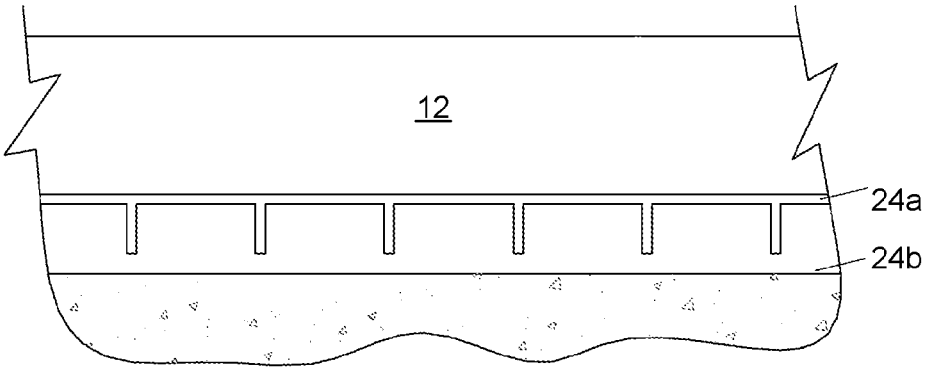
Figure 6:
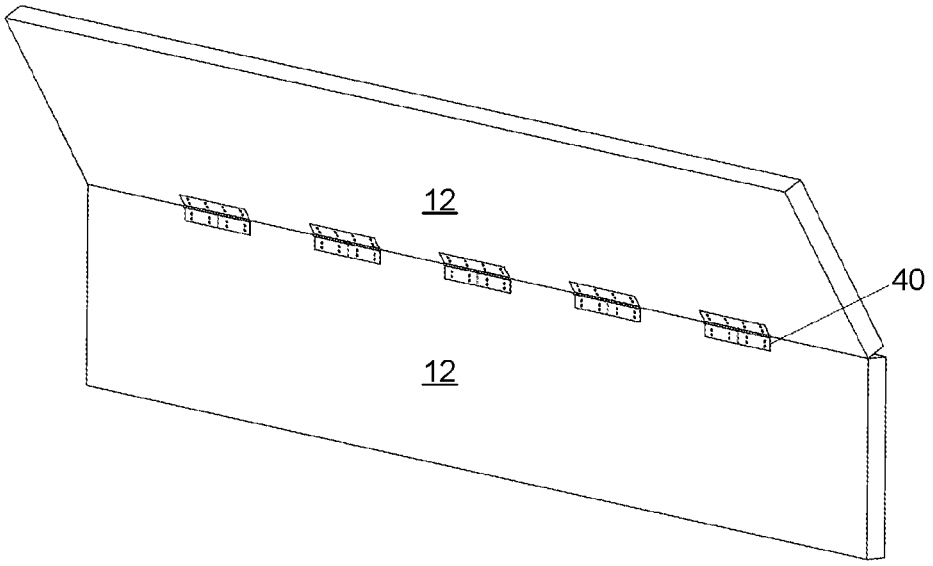
FIG. 6 shows details of a rotating joint.
Figure 7:
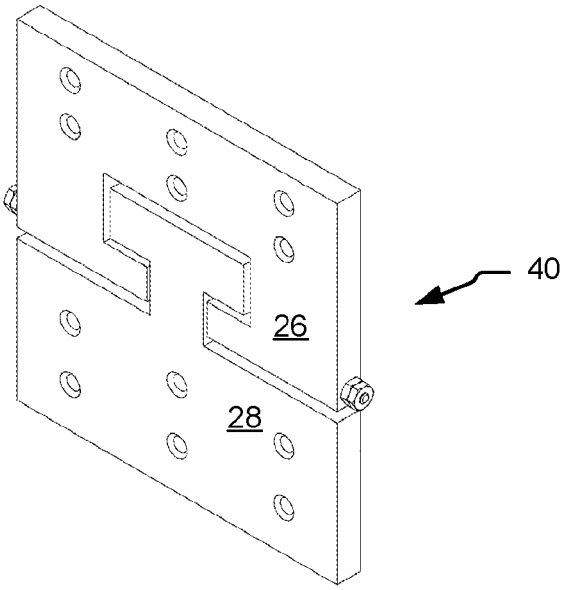
FIG. 7 shows additional details of the rotating joint, including an inter-panel locking mechanism.

FIG. 1 is a blown up schematic depiction of a door 10, here a roll up door 10*a*, in accord with the present invention. The roll up door 10*a* includes a set of door panels 12, end posts 14, a top header 16, a motion detector 18, side locking mechanisms 20 (having male and female parts 20*a*, 20*b* as shown), a top locking mechanism 22 (having male and female parts 22*a*, 22*b* as shown), a bottom locking mechanism 24 (having male and female parts 24*a*, 24*b* as shown), inter-panel locking mechanisms 26, 28 (see also FIG. 7), post top connectors 34, and post bottom connectors 36. FIG. 2 shows how the door panel 12 of FIG. 1 has a backing grid 38. FIG. 3 shows details of the side locking mechanism 20, 20*a-b*. FIG. 4 shows details of the top locking mechanism 22, 22*a-b*. FIG. 5 shows details of the bottom locking mechanism 24 (two types). FIG. 6 shows details of a rotating joint 40 between door panels 12. FIG. 7 shows additional details of the rotating joint 40, including the inter-panel locking mechanism 26, 28.

The roll up door 10*a* is made of lateral resisting door panels 12 and is segmented so it can be rolled up. The lateral load is transferred by typical construction attachments to the top header 16. The door panels 12 are locked on the sides to transfer up and down forces to the end posts 14, and locked at the bottom to transfer the lateral load to the foundation or the supporting floor below when the roll up door 10*a* is in the closed position.

The door panels 12 are main shear load resisting elements. The door panel 12 can be made of metal in a backing grid 38 (FIG. 2). Each backing grid 38 can be filled with a wood frame that is screwed to the metal grid. A plywood panel then gets nailed over the wood frame, as infill. The panel can be further strengthened using metal x-bracing, as shown in FIG. 2.

Each segment of a door panel 12 is interconnected on the front or back with a rotating joint 40 that allows for rotation and for transfer of shear with nailing, screwing, or welding of rotating joints to adjoining door panels 12. The door panels 12 are also inter-connected at each end with the inter-panel locking mechanism 26, 28, which is capable of large rotations and yet also able to transfer both shear and uplift from one door panel 12 to the next.

The top header 16 is connected to a door panel 12 with the top locking mechanism 22, 22*a-b*. The top locking mechanism 22 consists of two strips, parts 22*a-b*. The upper strip is connected to the top header 16 and the lower strip is connected to the top door panel 12 with screws or bolts. These strips are of high strength material capable of transferring considerable load in a bearing manner. The upper strip has slits and the lower strip has shear keys protruding from it. The slits and shear keys are aligned and when the roll up door 10*a* is in the closed position the shear keys are inserted into the slits of the upper strips. The lateral load from the upper strip is transferred to the lower strip through loads bearing on the shear keys.

The lateral load of the door panel 12 is transferred to the structure below or to the foundation with a similar principal as the top locking mechanism 22, 22*a-b*, with the bottom locking mechanism 24, 24*a-b* (FIG. 5 shows two variations, wherein one is similar except that the lower strip is replaced by foundation concrete that is formed to create accommodating keys for the bottom of the roll up door 10*a*). The concrete keys can be beveled to avoid tripping. When one of the constructions shown in FIG. 5 is not practical, the shear load from the door panel 12 can be transferred by direct bearing to an end post 14 (see e.g., FIG. 10, section A-A). This method can also be used to further enhance the shear transfer in addition to the scheme shown in FIG. 5.

Figure 8:
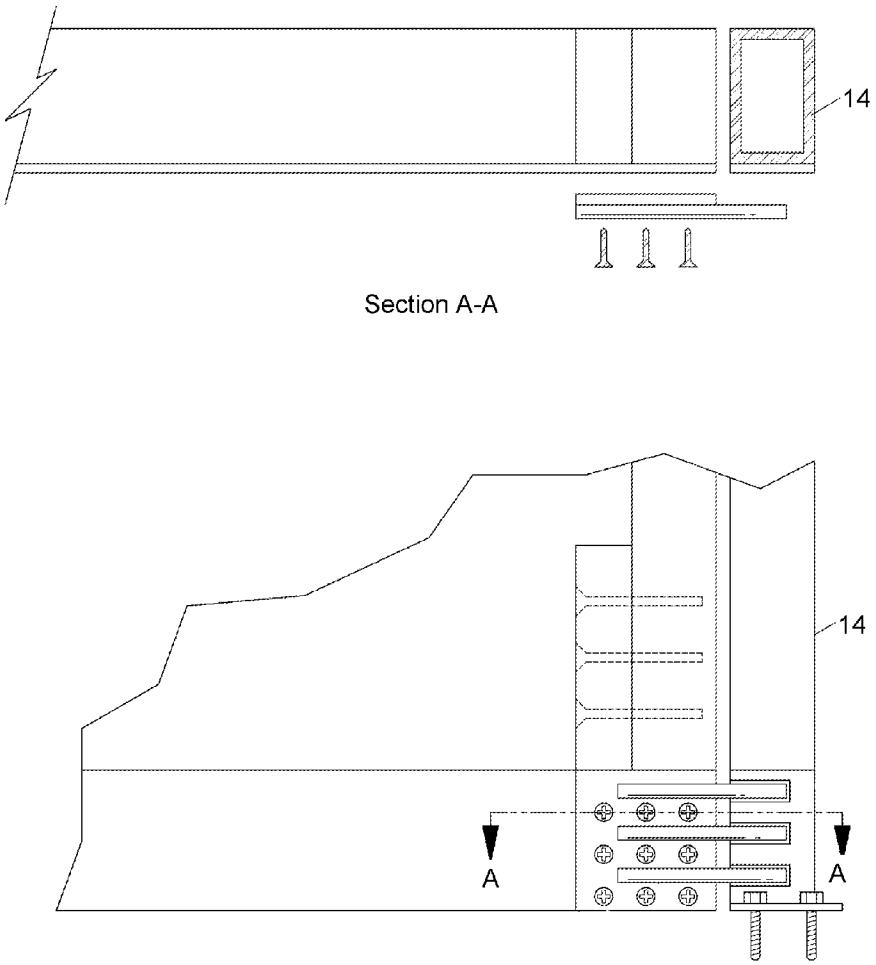
FIG. 8 shows how the uplift force can be transferred from the end post to the foundation with anchor bolts.

The upward or downward load of the door panel 12, or segmented panels, is achieved with the side locking mechanisms 20, 20*a-b* (FIG. 3). Metal strips that are connected to an end post 14 rotate 180 degrees and get locked into the strips that connected to the face of the door panel 12 at each end. The locking strip on the end post 14 rotates when the roll up door 10*a* gets in the closed position by a gear system (see e.g., FIG. 3) that rotates 180 degrees when the roll up door 10*a* goes from the open to the closed position. [Other options are commercially available actuators and sensors that can be used to replace the pulley and cable.] The uplift force is transferred from the end post 14 to the foundation with anchor bolts (FIG. 8). An alternate to this is to use a bearing plate to transfer the uplift force to the top header 16, and then the top header 16 transfers it to the end post 14 via a post top connector 34. FIGS. 9*a-b* show views of the post top connector 34. And FIG. 10 shows details of the post bottom connector 36.

The motion detector 18 can be a commercially available unit that can be installed over the top header 16, to signal closure of the roll up door 10*a* if an earthquake event occurs when the roll up door 10*a* is open, provided that there is no obstruction at the threshold. The closure of the roll up door 10*a* takes 4 to 5 seconds, long before the strongest part of an earthquake motion begins.

The strength of the frame (backing grid 38), its infill and plywood, the end posts 14, the top header 16, and all connectors and the locking system are adjusted based on the seismic load and dimensions (e.g., height and width) of the roll up door 10*a*.

Tilt Up Door

FIG. 11 is a blown up schematic depiction of another door 10, here a tilt up door 10*b*, in accord with the present invention. The tilt up door 10*b* includes a door panel 52, end posts 14, a top header 16, a motion detector 18, side locking mechanisms 20 (with parts 20*a-b*), a top locking mechanism 22 (with parts 22*a-b*), a bottom locking mechanism 24 (with parts 24*a-b*), post top connectors 34, and post bottom connectors 36. FIG. 12 shows how the door panel 52 of FIG. 11 has a backing grid 54.

The tilt up door 10*b* is the same as the roll up door 10*a* in many regards, except that the door panel 52 here is made in one piece. The door panel framing (backing grid 54) can consist of continuous top and bottom plates and double studs at each end of the tilt up door 10*b*, and intermediate studs at 12 or 16 inches on center. Framing can be done with wood or metal studs. The shear strength of the door panel 52 is achieved by applying plywood or metal sheeting over studs that are screwed or nailed to framing at close intervals. All other aspects of the tilt up door 10*b* in terms of the top header 16, end posts 14, locking, etc., can be the same as for the roll up door 10*a*.

FIGS. 13*a-b* show all of this in further detail for the tilt up door 10*b*, in open and closed positions.

Sliding Door

FIG. 14 is a blown up schematic depiction of another door 10, here a sliding door 10*c*, in accord with the present invention. The sliding door 10*c* includes a door panel 62, a top header 64, end posts 66, a top track 68, door roller and hanging mechanisms 70, a top locking mechanism 72 (with parts 72*a-b*), a bottom locking mechanism 74 (with parts 74*a-b*), track supports 80, foundation connections 82, and bearing blocks 84. FIG. 15 shows the door roller and hanging mechanism 70, which hangs from the top track 68 and connects to the top of the door panel 62. FIG. 16 shows details, in two positions, of the top connection of the sliding door 10*c*. FIG. 17 shows details of the bottom connection, in three positions, of the sliding door 10*c*.

The sliding door 10*c* only uses one single door panel 62 per frame. So, for a two-leaf sliding door 10*c*, two assemblies are required. The idea is to provide seismic resistance in multiple (at least two) panels in bay garages. The sliding door 10*c* can also be used to provide seismic resistance in the interior of a building while allowing spaces to be open to each other.

The assembly consists of one single door panel 62, a top header 64, end posts 66 (one at each end connected to the foundation or floor below), a top track 68 that allows the sliding door 60 to slide (in this example applied to top of the wall), top and bottom locking mechanisms 72, 74, and uplift load bearing applied at each end to the top of the sliding door 10*c*.

The door panel 62 is the main shear load resisting element. The door panel 62 is made of wood or steel shear walls (typically consisting of top and bottom plates with interior studs spaced at 16 or 24 inches on center) and shear resistance is provided by plywood, OSB, or metal sheeting applied to the studs. The door panel 62 can also be X-braced or use any other bracing system (not shown)

The top track 68 is connected to the top header 64 with screws, and door roller and hanging mechanisms 70 are supported from the top track 68. The door roller and hanging mechanisms 70 are attached to the top of the sliding door 10*c* and have wheels that roll inside the top track 68.

The top locking mechanism 72, between the top track 68 and the door panel 62, transfers lateral (shear) force from the top track 68 to the top of the door panel 62. The top locking mechanism 72 consists of a metal strip of full length track (may be used in each side if the shear load is high). This strip is screwed or welded to the side of top track 68. It has a jagged edge that interlocks with the strip that is connected to the top of the sliding door 10*c*. The strip in the top of the sliding door 10*c* swings 180 degrees when the sliding door 10*c* reaches the end post 66 and interlocks with the strip on the top track 68. The shear force is transferred in a load bearing manner between the interlocking strips.

The door panel 62 is interlocked with the foundation or floor below in the same way. When the door is installed over a garage floor, a high strength interlocking strip is laid at the time of foundation construction with anchors that are embedded into the footing (the bottom locking mechanism 74). The interlocking strip projects above the top of the foundation slab about ½ inch and provides a load bearing surface for the jagged edge of the door bottom locking strip (each hub provides a load bearing surface). If needed, the strip can be grooved at the center to provide a bottom track. When the sliding door 10*c* reaches the end post 66 a trigger mechanism causes the jagged strip at the bottom of the door to rotate 180 degrees into cavities in the bottom strip and the shear force is transferred from the protruding part of the door's lower interlocking strip to the hub of the footing interlocking strip. When the sliding door 10*c* is not installed on a foundation, the strip needs to be connected to a support member designed by an engineer. Another option is to form the top of the foundation in a form or for a lower strip to provide load bearing edges directly on the concrete.

The upward load due to overturning of the door panel 62 is resisted by transferring the upward force to the header with a load bearing mechanism. The top header 64 transfers the upward forces it receives to an end post 66 via a post cap (track support 80). The end post 66 transfers uplift loads to the foundation and completes the load path.

Vertical Fold Up Door

FIG. 18 is a blown up schematic depiction of another door 10, here a vertical fold up door 10*d*, in accord with the present invention. The vertical fold up door 10*d* is the same as the roll up door 10*a*, except that door panels 102 fold up under a top header 104. The top panel 102*a* is half-width, so that in folded condition the door panels 102 are centered under the top header 104. The connection of the top panel 102*a* to the top header 104 is final, which is achieved with the joined manner depicted in FIG. 1 for the roll up door 10*a*. The fold up door 10*d* rolls up and down with wheels 106 that are provided on the sides of each of the two end posts 14. Side locking, bottom locking, panel to panel connection, header to the end post connection, and post to foundation connection are all the same as for the roll up door 10*a*.

The mechanism for engaging the locking systems for the vertical fold up door 10*d* are as follows. A central rod 108 goes through a hinge 110 connecting the top panel 102*a* to the top header 104 and has gears 112 (one at each end) that rotate around the longitudinal axis of the central rod 108. The central rod 108 goes through a side locking strip 114*a* (connected to the end post 14) that also has a gear 112 at the top. The two gears 112 interact so that, when the top panel 102*a* rotates 90 degrees from the open to the closed position the vertical gear 112 rotates 90 degrees and rotates the horizontal gear 112 by 180 degrees, and the side locking strip 114*a* rotates into the jagged edge strap 114*b* at the side of the door 10. This occurs on both sides of the fold up door 10*d*. All other aspects of the vertical fold up door 10*d* can be the same as roll up door 10*a*.

FIG. 19 shows this in more detail, and FIGS. 20*a*-*b* show this in further detail for the vertical fold up door 10*d* when in open and closed positions.

Horizontal Fold-Up Door

A horizontal fold up door is the same as the vertical fold up door 10*d* except that: a) the door panels fold to the side (toward the end posts), b) the side locking mechanisms are applied at the tops of the panels, and c) the top connection of vertical door is applied between the last panel and the end post.

While various embodiments have been described above, it should be understood that they have been presented by way of example only, and that the breadth and scope of the invention should not be limited by any of the above described exemplary embodiments, but should instead be defined only in accordance with the following claims and their equivalents.

What is claimed is:

1. An earthquake resisting door having an open position and a closed position, the door comprising:

at least one door panel;

end posts located at left and right sides of said at least one door panel;

side locking mechanisms having male and female parts, wherein one of said side locking mechanisms is located between each said end post and said at least one door panel, and wherein male and female parts of each said side locking mechanisms inter-lock when the door is in the closed position;

a top locking mechanism having male and female parts, said top locking mechanism located above a top most said at least one door panel, and wherein said male and female parts of said top locking mechanism inter-lock when the door is in the closed position; and a bottom locking mechanism having male and female parts, said bottom locking mechanism located below a bottom most said at least one door panel, and wherein said male and female parts of said bottom locking mechanism inter-lock when the door is in the closed position.

2. The door of claim 1, wherein each said at least one door panel has a backing grid.

3. The door of claim 1, wherein said at least one door panel is a single panel such that the door is a tilt up type door.

4. The door of claim 1, wherein said at least one door panel is a single panel such that the door is a sliding type door.

5. The door of claim 4, further comprising a top track and a door roller and hanging mechanism which hangs from said top track and connects to the top of said single panel.

6. The door of claim 1, wherein each said at least one door panel includes at least two panels and the door is a sliding type door.

7. The door of claim 6, further comprising a top track and door roller and hanging mechanisms which hang from said top track and connect to the tops of said at least two panels.

8. The door of claim 1, wherein each said at least one door panel includes at least two panels that interlock to create an arrangement of segments that create brace frame action.

9. The door of claim 1, wherein each said at least one door panel includes at least two panels and the door is a roll up type door.

10. The door of claim 1, wherein each said at least one door panel includes at least two panels and the door is a fold up type door.

11. The door of claim 1, wherein each said at least one door panel includes at least two panels connected by a rotating joint.

12. The door of claim 11, wherein said rotating joint includes an inter-panel locking mechanism.

13. The door of claim 1 in a garage opening.

14. The door of claim 1 in a store front.

15. The door of claim 1 in an open floor area.

16. An earthquake resisting door having an open position and a closed position, the door comprising:

at least one door panel;

end posts located at left and right sides of the door;

a top track and a door roller and hanging mechanism which hangs from said top track and connects to a top or tops of said at least one door panel, and the door is a sliding type door;

a top locking mechanism having male and female parts, said top locking mechanism located above a top edge or edges of said at least one door panel, and wherein said male and female parts of said top locking mechanism inter-lock when the door is in the closed position; and a bottom locking mechanism having male and female parts, said bottom locking mechanism located below a bottom edge or edges of said at least one door panel, and wherein said male and female parts of said bottom locking mechanism inter-lock when the door is in the closed position.

* * * * *